US007083830B2

(12) United States Patent
Minko

(10) Patent No.: US 7,083,830 B2
(45) **Date of Patent: *Aug. 1, 2006**

(54) ELECTROSTATICALLY-ASSISTED HIGH-SPEED ROTARY APPLICATION PROCESS FOR THE PRODUCTION OF SPECIAL EFFECT BASE COAT/CLEAR COAT TWO-LAYER COATINGS

(75) Inventor: Peter Minko, Schwelm (DE)

(73) Assignee: E. I. duPont de Nemours and Company, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/677,514

(22) Filed: Oct. 2, 2003

(65) Prior Publication Data

US 2005/0074562 A1 Apr. 7, 2005

(51) Int. Cl.
*B05D 1/04* (2006.01)

(52) U.S. Cl. ..... 427/470; 427/475; 427/480; 427/484; 427/486

(58) Field of Classification Search ..... 427/480, 427/475, 484–486, 470; 118/626, 629; 239/700–703
See application file for complete search history.

(56) References Cited

U.S. PATENT DOCUMENTS 5,865,380 A * 2/1999 Kazama et al. ..... 239/704
6,093,497 A 7/2000 Wiemann et al.
2004/0137165 A1 7/2004 Lassmann et al.

FOREIGN PATENT DOCUMENTS

EP 0379373 A1 7/1990
EP 1418009 A2 5/2004
WO WO 0179360 A1 10/2001

OTHER PUBLICATIONS

Thomas Brock, European Coatings Handbook, Curt R. Vincentz Verlag, Hannover 2000, pp. 294 to 296.
Copy of the European Search Report Application No. EP 04023267, Mailed: Feb. 16, 2006.

* cited by examiner

*Primary Examiner*—Fred J. Parker
(74) *Attorney, Agent, or Firm*—Chyrrea J. Sebree

(57) ABSTRACT

A process for the production of special effect base coat/clear coat two-layer coatings on substrates by application of a special effect base coat layer of a liquid special effect base coat onto the substrate in one or more successive spray passes, optional drying or curing of the special effect base coat layer, followed by application of a clear coat layer and curing of the clear coat layer, wherein, at least in the final spray pass, application of the special effect base coat proceeds by electrostatically-assisted high-speed rotary application using at least one high-speed rotary coating device comprising a high-speed rotary bell, wherein an electrode ring is rotatably positioned around the high-speed rotary bell and used for external electrostatic charging of the effect base coat spray mist and performs rotational movements about the common axis of rotation with the high-speed rotary bell.

6 Claims, 4 Drawing Sheets

ELECTROSTATICALLY-ASSISTED HIGH-SPEED ROTARY APPLICATION PROCESS FOR THE PRODUCTION OF SPECIAL EFFECT BASE COAT/CLEAR COAT TWO-LAYER COATINGS

FIELD OF THE INVENTION

The invention relates to a process for the production of special effect base coat/clear coat two-layer coatings.

BACKGROUND OF THE INVENTION

Motor vehicles and automotive parts in particular are today provided with base coat/clear coat two-layer coatings, predominantly with a corresponding special effect coating comprising a base coat which imparts color and/or lightness flop (special effect-imparting base coat, special effect base coat) and a protective, gloss-imparting clear coat applied thereover. "Color and/or lightness flop" describes the behavior of such coatings with regard to imparting a different apparent color and/or lightness when observed from different angles. This behavior is obtained as a consequence of special effect agents or pigments contained in the special effect base coats, in particular, for example, metal flake pigments or mica pigments.

When producing single-tone base coat/clear coat two-layer coatings, the single-tone base coat is conventionally applied by means of electrostatically-assisted high-speed rotary application. This is not conventional when producing special effect base coat/clear coat two-layer coatings, the special effect base coat instead generally being applied in two spray passes. In this case, spray application proceeds in the first pass by means of electrostatically-assisted high-speed rotary application (approximately 60–70% of the special effect base coat layer), while, in the second pass, spray application generally proceeds by pneumatic spraying without electrostatic assistance (approximately 30–40% of the special effect base coat layer), c.f. A. Goldschmidt and H.-J. Streitberger, BASF-Handbuch Lackiertechnik [BASF coating techniques handbook], Vincentz Verlag, Hanover, 2002, page 730. While the final pneumatic spray application does indeed have the disadvantage of lower application efficiency associated with increased losses due to overspray, it guarantees excellent optical quality of the finished special effect base coat/clear coat two-layer coatings with regard to pronounced and uniform development of the special effect, avoidance of clouding and overall appearance. If the subsequent pneumatic spray application is replaced by electrostatically assisted high-speed rotary application, the optical results achieved are generally less good, in particular, in the case of special effect base coats in very light metallic shades or with a strong color flop.

SUMMARY OF THE INVENTION

The present invention makes it possible to produce special effect base coat/clear coat two-layer coatings having the high level of optical quality typical of pneumatic application of the special effect base coat, while nevertheless avoiding the above-mentioned pneumatic spray application which is associated with undesirably high overspray rates. Using the present invention in different coating lines also makes it possible to achieve greater optical conformity in the coating results obtained from these different coating lines with substrates provided with per se identical special effect base coat/clear coat two-layer coatings. These advantages are achieved by electrostatically-assisted high-speed rotary application of the special effect base coat using at least one high-speed rotary coating device comprising a high-speed rotary bell, wherein an electrode ring is rotatably positioned around the high-speed rotary bell and used for external electrostatic charging of the effect base coat spray mist and performs rotational movements about the common axis of rotation with the high-speed rotary bell.

The invention accordingly relates to a process for the production of special effect base coat/clear coat two-layer coatings on substrates by application of a special effect base coat layer of a liquid special effect base coat onto the substrate in one or more successive spray passes, optional drying or curing of the special effect base coat layer, followed by application of a clear coat layer and curing of the clear coat layer, wherein, at least in the final spray pass, application of the special effect base coat proceeds by electrostatically-assisted high-speed rotary application using at least one high-speed rotary coating device comprising a high-speed rotary bell, wherein an electrode ring is rotatably positioned around the high-speed rotary bell and used for external electrostatic charging of the effect base coat spray mist and performs rotational movements about the common axis of rotation with the high-speed rotary bell.

DETAILED DESCRIPTION OF THE EMBODIMENTS

Figure 1:
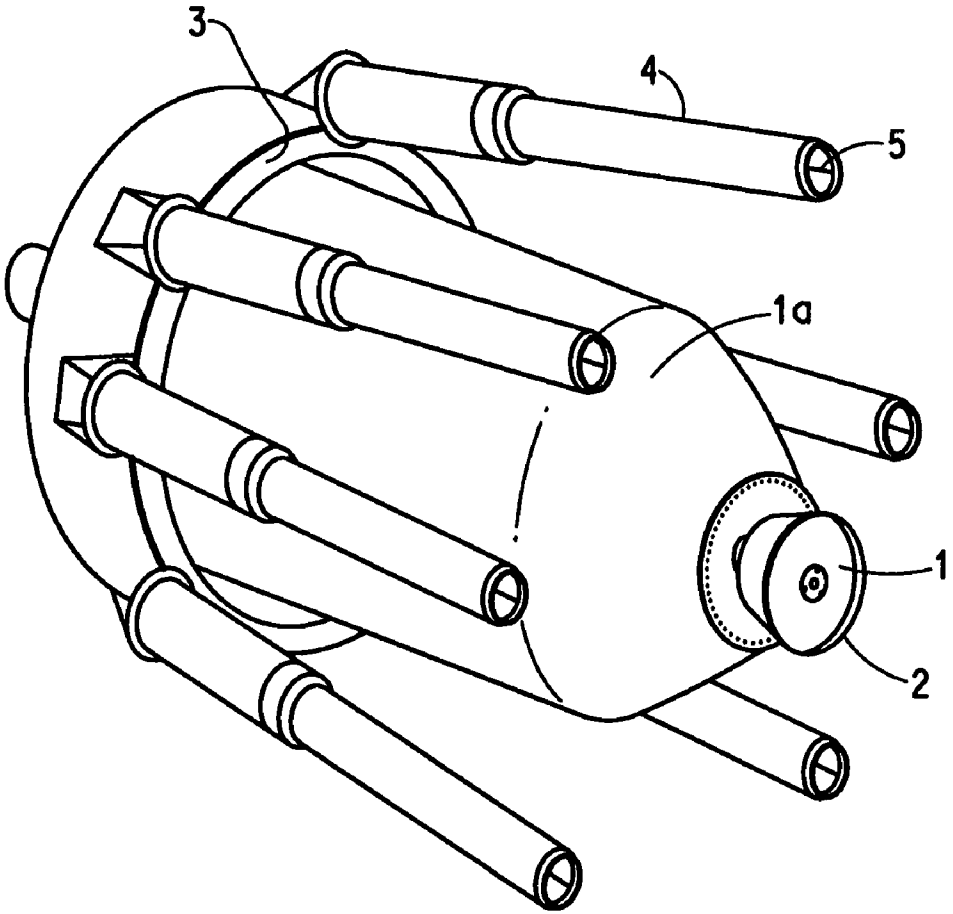
FIG. 1 shows a schematic representation of a high speed rotary bell.

The per se known materials (substrates, coating agents) used in the process according to the invention and the basic course of the coating process will first of all be explained below, before the features of the high-speed rotary coating device used for application of the special effect base coat and the mode of functioning and operation thereof are addressed in detail.

The substrates to be provided with a special effect base coat/clear coat two-layer coating in the process according to the invention may comprise substrates of any desired materials, in particular of metal and/or plastics. The substrates may be unpretreated or pretreated, uncoated or provided with a precoating of one or more coating layers. Examples of precoated substrates are metal substrates provided with an electrodeposition coating layer or with an electrodeposition coating layer and a primer surfacer layer or plastics substrates provided with a primer layer, for example an electrically conductive primer layer. In particular, the substrates are substrates which are to be industrially coated in large numbers, such as automotive bodies, body parts or body fittings.

In the process, according to the invention, the substrates are provided with a special effect base coat/clear coat two-layer coating. To this end, first of all the special effect base coat layer of a conventional liquid special effect base coat known to the person skilled in the art is applied to a dry film thickness of, for example, 8 to 20 μm.

The special effect base coats may comprise aqueous special effect base coats or such base coats based on organic solvents. In addition to a binder system comprising at least one binder and optionally, at least one cross-linking agent, water and/or organic solvent, optionally, together with conventional coloring pigments, extenders and/or conventional additives, the special effect base coats contain at least one special effect-imparting agent. The advantage achievable with the present invention is generally even greater in the case of aqueous special effect base coats than in the case of special effect base coats based on organic solvents.

Examples of binders are (meth)acrylic copolymers, polyester resins, urethanized polyesters, polyurethanes, polyureas and polyurethaneureas having number average molecular weights Mn of above 500 and in general of above 50000. A single binder or two or more binders as a mixture may be used. Hybrid binders derived from these classes of binders may also be used. These comprise polymer hybrids, wherein two or more types of binders may be combined covalently or in the form of interpenetrating resin molecules. Examples of polymer hybrid binders are polyester (meth) acrylates or polyurethane (meth)acrylates, in which polyester or polyurethane resin and (meth)acrylic copolymers are combined covalently or in the form of interpenetrating resin molecules.

Examples of cross-linking agents are aminoplast resins, free or blocked polyisocyanates and transesterification cross-linking agents.

Examples of solvents are glycol ethers, such as ethylene glycol monobutyl ether, diethylene glycol monobutyl ether, dipropylene glycol dimethyl ether, dipropylene glycol monomethyl ether, ethylene glycol dimethyl ether; glycol ether esters, such as ethylene glycol monoethyl ether acetate, ethylene glycol monobutyl ether acetate, 3-methoxy-n-butyl acetate, diethylene glycol monobutyl ether acetate, methoxypropyl acetate; esters, such as butyl acetate, isobutyl acetate, amyl acetate; ketones, such as methyl ethyl ketone, methyl isobutyl ketone, diisobutyl ketone, cyclohexanone, isophorone; alcohols, such as methanol, ethanol, propanol, butanol; aromatic hydrocarbons, such as xylene, SOLVESSO® (mixture of aromatic hydrocarbons with a boiling range of 155 to 185° C.); aliphatic hydrocarbons.

Examples of conventional coloring pigments are inorganic or organic coloring pigments, such as, titanium dioxide, iron oxide pigments, carbon black, azo pigments, quinacridone pigments, perylene pigments, pyrrolopyrrole pigments.

Examples of conventional extenders are silicon dioxide, aluminium silicate, barium sulfate, calcium carbonate and talcum.

Examples of conventional additives are wetting agents, anticratering agents, levelling agents, neutralizing agents, light stabilizers, thickeners and catalysts.

Examples of conventional special effect-imparting agents are metal pigments, for example, made from aluminum, copper or other metals; interference pigments, such as platelet pigments comprising two or more layers, for example, metal oxide-coated metal pigments such as titanium dioxide-coated or mixed oxide coated-aluminum, coated mica, such as, for example, titanium dioxide-coated mica, special effect pigments based on liquid crystals and pigments imparting a graphite effect.

The special effect base coat is applied in one or preferably in two or more, in particular, two successive spray passes. Where only one spray pass is used, said pass is the final spray pass. In the case of two or more, or in particular, two spray passes, a special effect base coat of identical composition may in each case be applied or a special effect base coat of a composition modified by the addition of an additional component may be applied in the spray pass or passes preceding the final spray pass. The addition of an additional component may, for example, be considered if the special effect base coat applied in the non-final spray pass or passes assumes additional functions, for example, replacing a conventional primer surfacer layer, or is intended to make it possible to dispense with baking of a conventional primer surfacer by means of wet-on-wet overcoating with unmodified special effect base coat and clear coat. Examples of additions made for this purpose are the addition of polyisocyanate cross-linking agents described in WO 97/4740 or the addition of polyurethane resin described in U.S. Pat. No. 5,976,343 or the addition of a filler paste described in U.S. Pat. Nos. 5,709,909 or 5,968,655.

Even in the case of two or more spray passes, the resulting coating layer is designated a "special effect base coat layer", irrespective of the number of special effect base coat spray passes and irrespective of the possibility that, as described in the preceding paragraph, the special effect base coat used in the final spray pass may exhibit a solids composition which differs from that of the special effect base coat used in the preceding spray pass or passes.

There may be a flash-off phase of, for example, 30 seconds to 5 minutes at 20 to 35° C. between the individual special effect base coat spray passes.

On completion of the final spray pass and thus application of the special effect base coat, the special effect base coat layer may initially be dried or cured (cross-linked), for example, depending on the chemistry of the binder system of the special effect base coat, by thermal curing and/or by curing by the action of high-energy radiation (in particular UV radiation).

The clear coat may be applied onto the dried or cured special effect base coat layer, for example, to a dry film thickness of 30 to 75 μm and, likewise depending on the chemistry of the binder system of the clear coat, be cured by thermal curing and/or by curing by the action of high-energy radiation (in particular UV radiation).

The special effect base coat/clear coat two-layer coating is preferably applied by the wet-on-wet process, i.e. the special effect base coat layer is not dried or cured before application of the clear coat, but merely flashed off, for example, for 90 seconds to 5 minutes at 20 to 80° C. and, after the flash-off phase, is overcoated with a clear coat to a dry film thickness of preferably 30 to 75 μm and dried or cured jointly therewith at temperatures of, for example, 80 to 140° C.

The clear coat is applied by spraying, in particular, by electrostatically-assisted high-speed rotary application. It is also possible in the case of electrostatically-assisted high-speed rotary application of the clear coat to use the principle applied in the final spray pass during application of the special effect base coat, namely using at least one high-speed rotary coating device comprising a high-speed rotary bell, wherein an electrode ring is rotatably positioned around the high-speed rotary bell and used for external electrostatic charging of the, in this case, clear coat spray mist and performs rotational movements about the common axis of rotation with the high-speed rotary bell.

Any desired clear coat coating agent may be used to produce the clear coat layer. Suitable clear coats are in principle any known clear coats which may be cured thermally and/or by the action of high-energy radiation, for example, UV radiation. Usable clear coats are here both one-component (1 pack) or two-component (2 pack) clear coats based on organic solvents, water-dilutable 1 pack or 2 pack clear coats, powder clear coats or aqueous powder clear coat dispersions.

All the special effect base coat spray passes proceed by means of electrostatically-assisted high-speed rotary application, it being essential to the invention that at least the final spray pass proceeds with the use of at least one high-speed rotary coating device comprising a high-speed rotary bell, wherein an electrode ring is rotatably positioned around the high-speed rotary bell and used for external electrostatic charging of the effect base coat spray mist and performs rotational movements about the common axis of rotation with the high-speed rotary bell. In the case of special effect base coat application in more than one spray pass, the spray passes preceding the final spray pass may be performed using the same technique or, in accordance with the known prior art, it is possible to use an electrode ring which does not perform rotational movements.

The high-speed rotary coating device comprises a conventional high-speed rotary bell known to the person skilled in the art, which requires no further explanation, and an electrode ring which is known per se and with regard to its basic function.

The electrode ring is a per se conventional electrode ring, known to the person skilled in the art, suitable for providing electrostatic assistance to the high-speed rotary application of the effect base coat, wherein, at variance with the prior art, the electrode ring is constructed so as to be capable of performing rotational movements about an axis directed through the center of the circle thereof. In other words, the electrode ring comprises means which are suited to causing it to be set or to setting it in rotational movements about an axis directed through the center of the circle thereof, such that during high-speed rotary application of the effect base coat the electrode ring can rotate or oscillate in rotational manner.

The electrode ring used for external electrostatic charging of the effect base coat spray mist performs one or more different and successive rotational movements about the common axis of rotation with the high-speed rotary bell, for example, rotational movements, oscillatory movements or sequences thereof.

FIG. 1 shows a schematic representation of a typical arrangement of high-speed rotary bell (1) with bell housing (1*a*), spray edge (2) and electrode ring (3) with electrode fingers (4) and electrode tips (5) according to the prior art.

Figure 2:
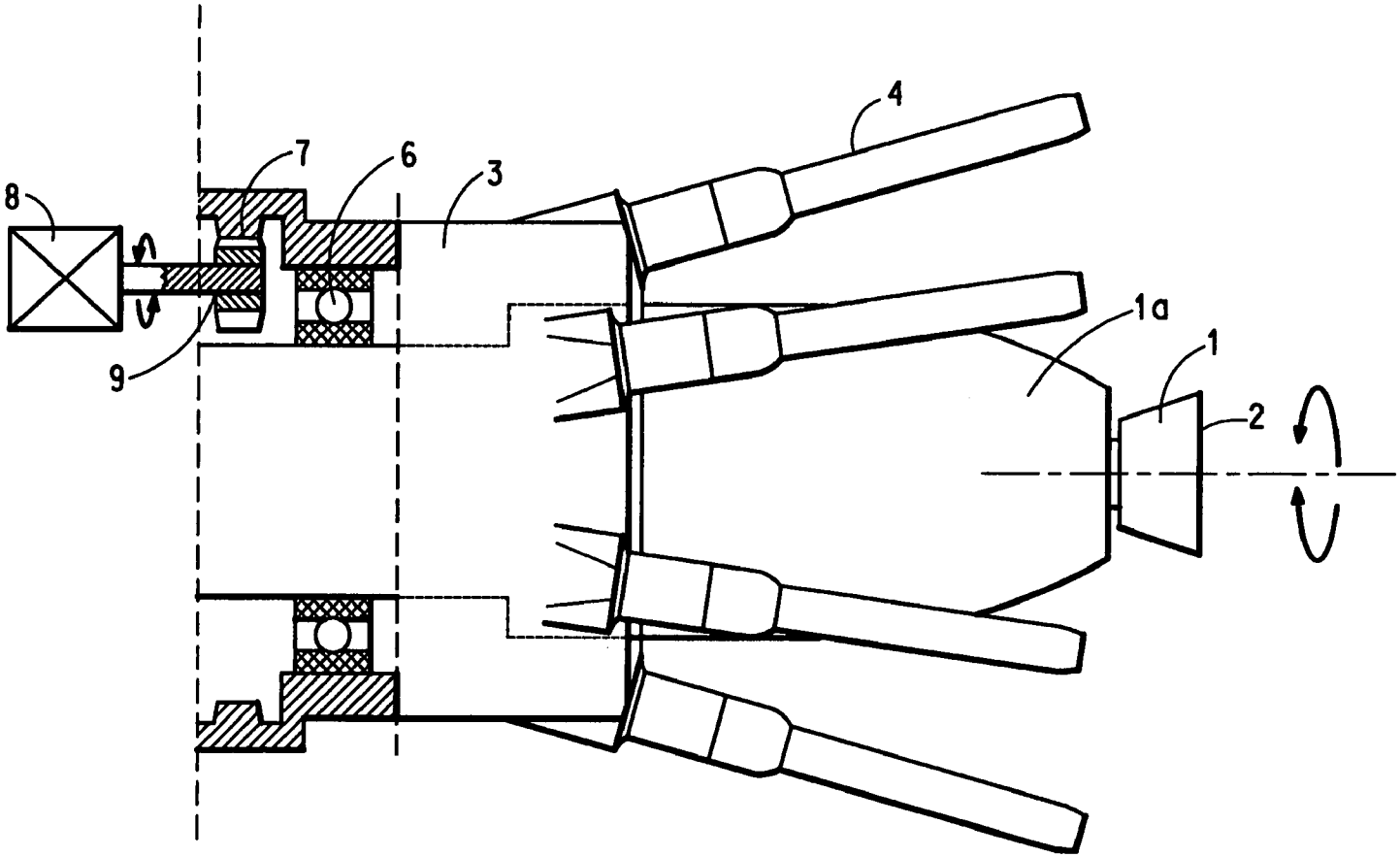
FIG. 2 shows a schematic partially longitudinal section of an electrode ring.

FIG. 2 shows a schematic, partially longitudinal section of one embodiment of an electrode ring (3) that can be used in the process according to the invention and which is firmly connected with the housing of a high-speed rotary bell (1) via an annular ball bearing (6) arranged between the inside of the electrode ring and the outside of the housing (1*a*) of the high-speed rotary bell (1), but is consequently permitted to move rotationally in both directions of rotation (as shown by the two large arrows) around the axis of rotation of the high-speed rotary bell. The inside of the electrode ring (3) comprises a toothed ring (7), by means of which the electrode ring (3) may be set in rotational movement in both directions of rotation (as shown by the two small arrows) by means of a gear transmission (9) drivable by means of a motor (8). When observed from the outside, the arrangement of high-speed rotary bell (1) and electrode ring (3) as shown in FIG. 2 does not differ from the arrangement in FIG. 1. In this respect, FIG. 1 is not only a representation of an arrangement according to the prior art, but also represents an arrangement of high-speed rotary bell (1) and electrode ring (3) in the embodiment according to FIG. 2.

The electrode ring (3) is not made in a single piece, but instead consists of a fastening device, (hereinafter also referred to as a fastening ring), firmly connectable with the housing of the high-speed rotary bell (1) which is connected with the actual electrode ring (3) (hereinafter also referred to only as electrode ring for simplicity's sake) by means of a bearing connection. The bearing connection may here simultaneously perform the function of the fastening device or may be the fastening device or a part thereof. The bearing connection may, for example, consist of a ball bearing, a roller bearing, a plain bearing or an air bearing.

The fastening ring may be connected in any desired firmly fixed manner with the housing (1*a*) of the high-speed rotary bell, for example, by screw fastening, clamping (flange joint) or by seating the fastening ring in the bell housing. The fastening ring is fastened in such a manner that the electrode ring (3) and high-speed rotary bell (1) assume the conventional arrangement as in the prior art, namely, aligned in such a manner that the electrode ring (3) surrounds the high-speed rotary bell (1) located in the center thereof in annular manner, wherein the high-speed rotary bell (1) and electrode fingers (4) of the electrode ring point in the same direction, namely towards a substrate to be spray coated with effect base coat.

The structure of the actual electrode ring (3) is in principle no different from that of conventional electrode rings known to the person skilled in the art. It has two or more, for example, 3 to 8, preferably 4 to 6, electrode fingers (4) uniformly spaced apart in a circle, to the tips (5) of which electrodes, which are directed in the spraying direction, can be applied a high voltage. Electrical contacting of the electrode tips (5) may in particular be achieved, for example, via a direct sliding contact, for example, in the form of a panel of spring steel in or on the actual electrode ring (3), wherein the sliding contact is in connection with a stationary sliding surface, to which the required high voltage is applied. The stationary sliding surface may, for example, be a component of the fastening ring.

With the exception of the electrode tips (5), the electrode ring (3) is an electrical insulator. The electrode ring (3) or the outer surface thereof generally consists of plastic. As with conventional electrode rings, the internal diameter of the electrode ring is adapted to conventional high-speed rotary bells and is, for example, approximately 100 to 150 mm, while the external diameter thereof measured at the electrode tips (5) is, for example, approximately 250 to 300 mm. The electrode fingers (4) are for example 200 to 250 mm in length, form an angle of for example 10 to 20° relative to the axis of rotation of the electrode ring (3) and point in the direction of the object to be spray coated with effect base coat.

The above-described bearing connection permits the electrode ring (3) to perform rotational movements about the axis passing through the center of the circle thereof. By means of a suitable drive, the electrode ring (3) can be set in rotational movements about the axis passing through the center of the circle thereof and, during high-speed rotary application of the effect base coat, perform rotational movements about the common axis of rotation with the high-speed rotary bell, i.e., either rotation or oscillatory rotational movements in each case around the rotating high-speed rotary bell.

An example of types of drives with which the actual electrode ring (3) may be set in rotational movements about the axis passing through the center of the circle thereof is a mechanical drive, for example, by means of an electric motor or a pneumatically driven motor (for example a pneumatically controlled turbine with driving and braking air) via a drive belt, for example, toothed belt or a transmission, for example, a gear transmission. The drive means may here be components of the electrode ring and/or separate components.

When the electrode ring (3) rotates, the direction of rotation may be the same as or contrary to the direction of rotation of the high-speed rotary bell (1) and the rotational speed of the electrode ring during application of the effect base coat is, for example, 10 to 100, preferably 15 to 75 revolutions per minute, wherein the rotational speed may preferably be modified steplessly, for example, adapted to the particular nature of the substrate to be coated with effect base coat. The direction of rotation of the electrode ring (3) during the coating operation may here remain unchanged or may alternate, for example, be alternated repeatedly.

In the case of oscillating rotational movements of the electrode ring (3), rotational movements periodically alternating in direction of rotation are performed, for example, with a frequency of alternation in the range from 0.5 to 2 Hz, wherein the individual rotational movements of the electrode ring (3) correspond to a deflection of the electrode ring (3) in the range of, for example, only 45 to 90°. In the case of oscillating rotational movements, the electrode ring (3) accordingly performs no complete rotations.

During high-speed rotational effect base coat coating of an object, rotation and oscillating rotational movement of the electrode ring (3) may also alternate in any desired sequence over time, for example, also alternate repeatedly in succession. It may, for example, be convenient when effect base coat coating large and simple areas of the surface (no or only slight curvatures with an up to infinite radius of curvature per unit of area) of an object to operate with a rotating electrode ring (3) and, when effect base coat coating surface areas of complex topography (many and/or pronounced curvature with a small radius of curvature, corners, beads, edges per unit of area), to operate with an oscillating electrode ring (3).

In the process according to the invention conventional high-speed rotary bells, known to the person skilled in the art, with spray edge diameters in the range of, for example, 40 to 70 mm are used and are operated under conventional operating parameters. For example, rotational speeds of the bell are from 10,000 to 70,000 revolutions per minute, the shaping air throughput 60 to 1000 STP litres (standard temperature and pressure litres) per minute and the effect base coat flow rate 30 to 1400 ml per minute. The high voltage applied to the electrode tips (5) is also in the usual range of, for example, 40 to 100 kV.

When using identical effect base coats, an identical high-speed rotary bell operated under likewise identical operating conditions and an identical electrode ring likewise operated under identical operating conditions but additionally performing rotational movements about the common axis of rotation with the high-speed rotary bell, the process according to the invention yields special effect base coat/clear coat two-layer coatings with reduced cloudiness, uniform and pronounced development of the special effect and overall better appearance. In comparison with the prior art process with a firmly fixed electrode ring which does not perform rotational movements, improvements in the efficiency of effect base coat application in the range of 3 to 10% in absolute terms (3 to 10 absolute-% less effect base coat overspray) are, for example, achieved.

It is assumed that the rotation or the oscillating rotational movements of the electrode ring (3) apply a more homogeneous electrical field to the effect base coat spray mist, as a consequence, it is possible to achieve the advantageous effects in comparison with the prior art process.

The process according to the invention is in particular suitable for the original spray coating of industrially mass produced goods, such as, in particular, automotive bodies and body parts. Spray application of the effect base coat here generally proceeds with two or more high-speed rotary bells simultaneously, each being provided with an electrode ring as described above and which is also driven as described above, which high-speed rotary bells are guided individually or also jointly as a group of two or more application devices over the surface of the object to be coated with effect base coat, in each case by means of an automatic device.

EXAMPLES

Example 1

A 1000 mm×1000 mm piece of automotive steel panel precoated with conventional commercial cathodic electrodeposition primer (18 μm) and conventional commercial primer surfacer (35 μm) was coated in two spray passes to a dry film thickness of 14 μm with a conventional commercial silver metallic water-borne base coat (Herberts Aqua Metallic Base, R 65522 from DuPont Performance Coatings GmbH & Co. KG, Wuppertal) and flashed off for 5 minutes at 60° C. The distribution of layer thicknesses of the base coat layer was then measured. The flashed off base coat layer was then overcoated wet-on-wet to a dry film thickness of 45 μm with a conventional commercial two-component PU (polyurethane) clear coat (100 parts by weight: 30 parts by weight mixture of Herberts Clear 2K, R 40473 and Herberts Hardener, R 65430, both from DuPont Performance Coatings GmbH & Co. KG, Wuppertal) by high-speed rotary application and, after 5 minutes flashing off at 20° C., was baked for 20 minutes at 130° C. (object temperature).

All coating, flashing off and baking operations were performed with the test panel in a vertical position.

During both spray passes, the base coat was applied by electrostatically assisted high-speed rotary application using the device shown in FIG. 1, wherein an electrode ring (3) was used which was rotatable about the common axis of the rotary bell and rotated with the high-speed rotary bell in the same direction as the rotary bell at 20 revolutions per minute during application of the base coat.

The coating parameters were:

Flow rate of base coat 250 ml/min,

Shaping air throughput 300 STP litres/min,

Rotational speed of bell, 40000 revolutions per minute,

High voltage 90 kV.

Comparative Example 2

The same method was used as in Example 1 with the sole exception that, during application of the base coat, the electrode ring remained firmly fixed around the high-speed rotary bell.

The layer thickness of the base coat layer was 14±1 μm in Example 1 and 14±3 μm in Example 2. Visual inspection of the special effect coating revealed a more uniform color appearance for Example 1 than for Example 2.

Example 3

A 300 mm×600 mm piece of automotive steel panel precoated with conventional commercial cathodic electrodeposition primer (18 μm) and conventional commercial primer surfacer (35 μm) was coated with the silver metallic water-borne base coat from Example 1 in a wedge-shaped gradient (wedge in longitudinal direction) to a dry film thickness range from 0 to 25 μm and, after 5 minutes flashing off at 60° C., was overcoated wet-on-wet by high-speed rotary application to a dry film thickness of 45 μm with the two-component PU clear coat from Example 1 and, after 5 minutes flashing off at 20° C., was baked for 20 minutes at 130° (object temperature).

The base coat was applied by electrostatically assisted high-speed rotary application using the device shown in FIG. 1, wherein an electrode ring (3) was used which was rotatable about the common axis of the rotary bell and rotated with the high-speed rotary bell in the same direction as the rotary bell at 20 revolutions per minute during application of the base coat.

All coating, flashing off and baking operations were performed with the test panel in a vertical position (thicker end of the base coat wedge pointing downwards).

The coating parameters were:

Flow rate of base coat 250 ml/min,

Shaping air throughput 300 STP litres/min,

Rotational speed of bell, 40000 revolutions per minute,

High voltage 90 kV.

Comparative Example 4

The same method was used as in Example 3 with the sole exception that, during application of the base coat, the electrode ring remained firmly fixed around the high-speed rotary bell.

The coatings obtained in Examples 3 and 4 were in each case assessed in accordance with the method known from U.S. Pat. No. 5,991,042 using the MICROMETALLIC™ instrument sold by BYK-Gardner. The correlation diagrams shown in FIGS. 3 (Example 3) and 4 (Example 4) are produced. The correlation diagrams show the measured values for lightness (y-coordinate: lightness L*25°, lightness in the L*,a*,b* color space, measured at an angle of 25° to the specular reflection) as a function of base coat layer thickness (x-coordinate: base coat layer thickness in μm).

Figure 3:
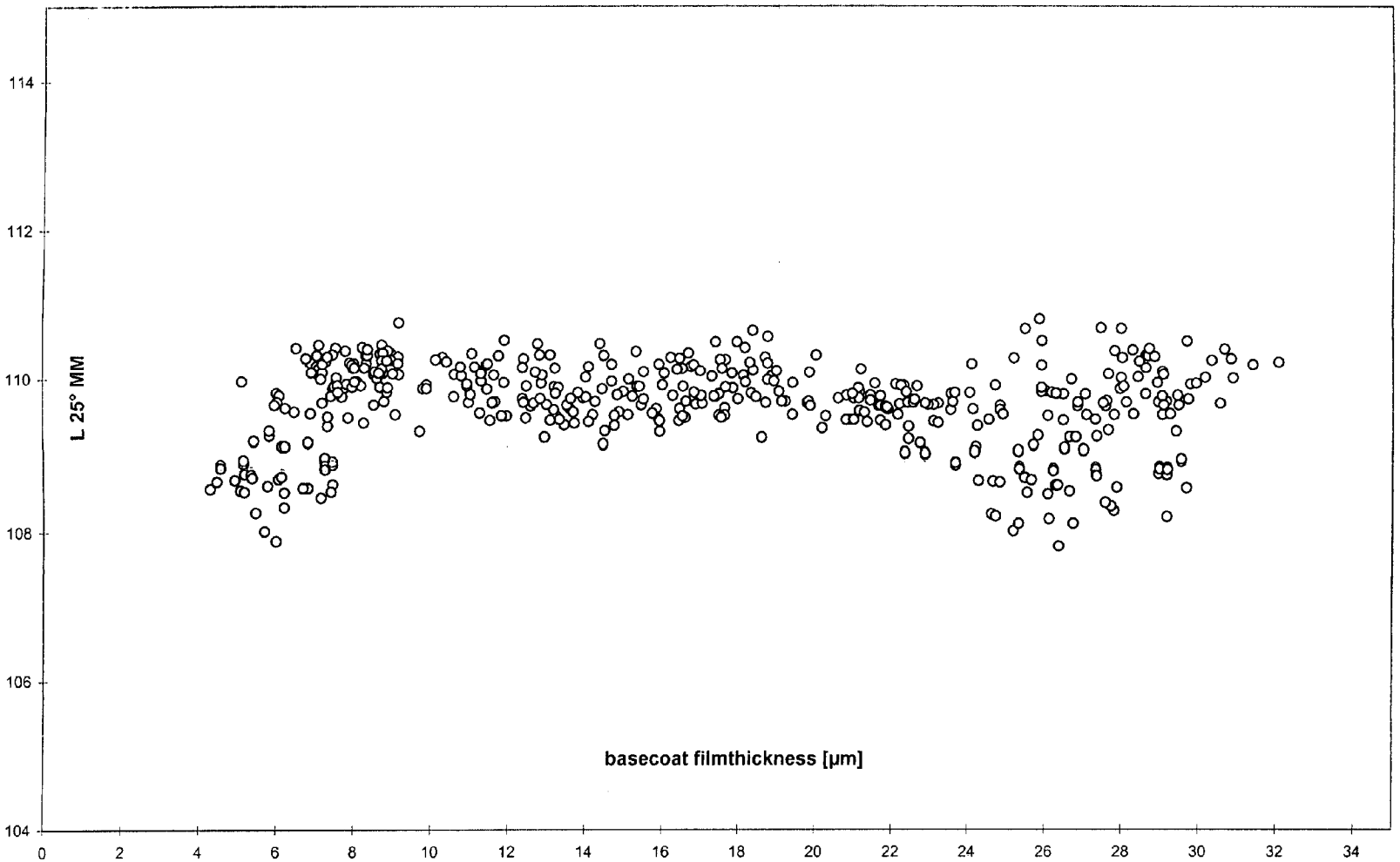
FIG. 3 shows a correlation diagram of values of lightness as a function of base coat layer thickness for Example 3.
Figure 4:
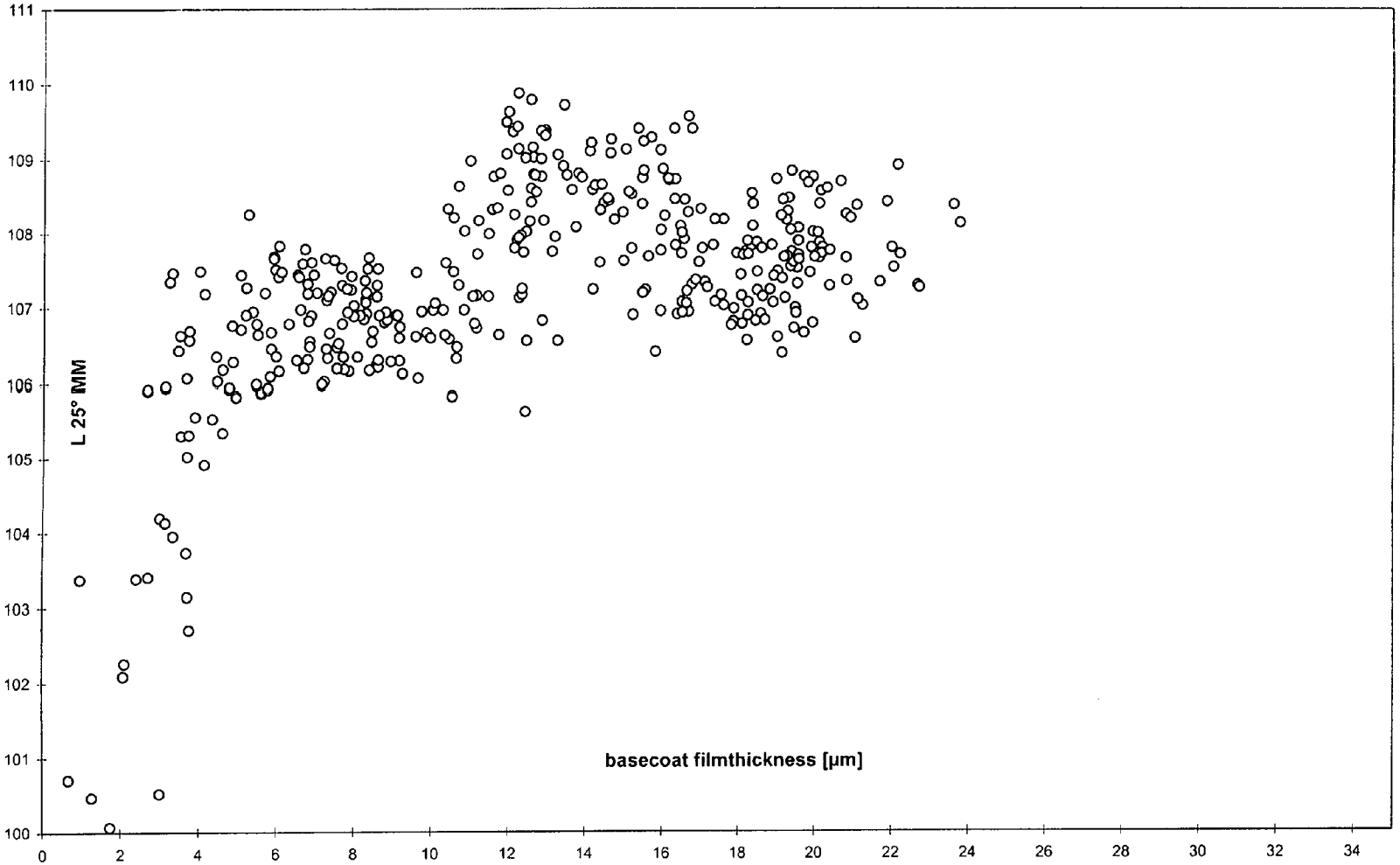
FIG. 4. shows a correlation diagram of values of lightness as a function of base coat layer thickness for Example 4.

Comparison of the correlation diagrams shown in FIGS. 3 and 4 reveals the superiority of the method according to Example 3:

the lightness of the coating produced by Example 3 according to the invention is higher (L*25° is approx. 110) than that of the coating from Comparative Example 4 (L*25° is approx. 107).

the coating of Example 3 according to the invention is less cloudy than that according to Comparative Example 4, which is manifested by the lower scatter of the L*25° values on comparison of the correlation diagrams. Moreover, this lower scatter is stable over a base coat layer thickness range of 8 to 20 μm.

What is claimed is:

1. A process for the production of special effect base coat/clear coat two-layer coatings on substrates, comprising the successive steps (a) applying a special effect base coat layer of a liquid special effect base coat onto the substrates in one or more successive spray passes, (b) optional drying or curing of the special effect base coat layer, (c) applying a clear coat layer, and (d) curing the clear coat layer, wherein, at least in the final spray pass, application of the special effect base coat proceeds by electrostatically-assisted high-speed rotary application using at least one high-speed rotary coating device comprising a high-speed rotary bell having a housing firmly connected to an electrode ring via a fastening device by means of a bearing connection, wherein the electrode ring is rotatably positioned around the high-speed rotary bell and used for external electrostatic charging of the effect base coat spray mist and performs rotational movements about the common axis of rotation with the high-speed rotary bell.

2. The process of claim 1, wherein the substrates comprise industrially mass-produced goods.

3. The process of claim 1, wherein the substrates are selected from the group consisting of automotive bodies, body parts and body fittings.

4. The process of claim 1, wherein the liquid special effect base coat comprises an aqueous special effect base coat.

5. The process of claim 1, wherein the rotational movements of the electrode ring comprise rotational movements selected from the group consisting of rotation at 10 to 100 revolutions per minute, oscillating rotational movement with a frequency of alternation of 0.5 to 2 Hz and sequences of said rotations and oscillating rotation movements.

6. The process of claim 1, wherein the bearing connection consists of a ball bearing, roller bearing, plain bearing, or air bearing.

* * * * *